US008114231B2

(12) United States Patent
da Silva et al.

(10) Patent No.: US 8,114,231 B2
(45) Date of Patent: Feb. 14, 2012

(54) GASSING OF EMULSION EXPLOSIVES WITH NITRIC OXIDE

(75) Inventors: Gabriel da Silva, Carlton (AU); Bogdan Z. Dlugogorsk, Anna Bay (AU); Eric M. Kennedy, The Hill (AU)

(73) Assignee: Newcastle Innovation Limited, Callaghan (AU)

( * ) Notice: Subject to any disclaimer, the term of this patent is extended or adjusted under 35 U.S.C. 154(b) by 643 days.

(21) Appl. No.: 12/091,658

(22) PCT Filed: Oct. 26, 2006

(86) PCT No.: PCT/AU2006/001596

§ 371 (c)(1), (2), (4) Date: Mar. 12, 2009

(87) PCT Pub. No.: WO2007/048192

PCT Pub. Date: Mar. 5, 2007

(65) Prior Publication Data

US 2009/0301619 A1 Dec. 10, 2009

(30) Foreign Application Priority Data

Oct. 26, 2005 (AU) ..... 2005905921

(51) Int. Cl.

*C06B 47/00* (2006.01)
*C06B 47/04* (2006.01)
*D03D 23/00* (2006.01)
*D03D 43/00* (2006.01)

(52) U.S. Cl. ..... 149/109.6; 149/1; 149/74; 149/108.8; 149/109.4

(58) Field of Classification Search ..... 149/1, 74, 149/108.8, 109.4, 109.6
See application file for complete search history.

(56) References Cited

U.S. PATENT DOCUMENTS

| | | | | |
|---|---|---|---|---|
| 3,288,658 | A | 11/1966 | Ferguson at al. | |
| 3,382,117 | A | 5/1968 | Cook | |
| 3,397,097 | A | 8/1968 | Atadan at al. | |
| 3,431,155 | A | 3/1969 | Dunglinson at al. | |
| 3,447,978 | A | 6/1969 | Bluhm | |
| 3,660,181 | A | 5/1972 | Clay et al. | |
| 3,706,607 | A | 12/1972 | Chrisp | |
| 3,711,345 | A | 1/1973 | Tomic | |
| 3,713,919 | A | 1/1973 | Tomic | |
| 3,770,522 | A | 11/1973 | Tomic | |
| 3,790,415 | A | 2/1974 | Tomic | |
| 3,886,010 | A | 5/1975 | Thornley et al. | |
| 4,008,108 | A | 2/1977 | Chrisp | |
| 4,081,299 | A | 3/1978 | Griffith | |
| 4,153,613 | A | 5/1979 | Bharucha et al. | |
| 4,221,616 | A | 9/1980 | McLean | |
| 4,368,330 | A | 1/1983 | Andrews | |
| 4,409,044 | A | 10/1983 | Bhattacharyya et al. | |
| 4,543,136 | A | 9/1985 | Edamura et al. | |
| 4,543,137 | A | 9/1985 | Edamura et al. | |
| 4,594,118 | A | 6/1986 | Curtin et al. | |
| 4,676,849 | A | 6/1987 | Curtin et al. | |
| 4,737,207 | A | 4/1988 | Ehrnstrom et al. | |
| 4,790,891 | A | 12/1988 | Halliday et al. | |
| 4,875,951 | A | 10/1989 | Prest et al. | |
| 4,997,494 | A | 3/1991 | Nguyen | |
| 4,997,958 | A | 3/1991 | Pauling et al. | |
| 5,017,251 | A | 5/1991 | Lawrence et al. | |
| 5,240,524 | A | 8/1993 | Chattopadhyay | |
| 5,397,399 | A | 3/1995 | Lownds | |
| 6,022,428 | A * | 2/2000 | Cranney et al. | 149/2 |
| 6,027,588 | A | 2/2000 | Vattipalli et al. | |
| 6,113,715 | A | 9/2000 | Halander et al. | |
| 6,165,297 | A | 12/2000 | Smith et al. | |
| 6,176,950 | B1 | 1/2001 | Wood et al. | |
| 6,261,393 | B1 | 7/2001 | Vestre | |
| 6,539,870 | B1 | 4/2003 | Granholm | |
| 6,800,154 | B1 * | 10/2004 | Carey et al. | 149/2 |
| 6,855,219 | B2 | 2/2005 | Alilovic et al. | |
| 6,877,432 | B2 | 4/2005 | Thomson et al. | |
| 6,951,589 | B2 * | 10/2005 | Pollack et al. | 149/2 |
| 6,995,731 | B2 | 2/2006 | Lin | |
| 2001/0012851 | A1 * | 8/2001 | Lundy et al. | 514/418 |
| 2003/0024619 | A1 | 2/2003 | Coolbaugh et al. | |
| 2011/0132505 | A1 * | 6/2011 | Dlugogorski et al. | 149/109.4 |

FOREIGN PATENT DOCUMENTS

| | | | |
|---|---|---|---|
| AU | 522741 | B2 | 6/1982 |
| AU | 578460 | B2 | 10/1988 |
| CA | 0 775 681 | A1 | 5/1977 |
| CA | 2040751 | A1 | 10/1991 |
| CA | 2239095 | A1 | 7/1997 |
| CA | 2213623 | A1 | 2/1998 |
| EP | 0775681 | A1 | 5/1997 |
| GB | 1536180 | A | 12/1978 |
| GB | 002257135 | A | 1/1993 |
| WOWO-PCT/US88/03354 | | | 6/1989 |

OTHER PUBLICATIONS da Silva G., et al., (2006) An Experimental and Theoretical Study of the Nitrosation of Ammonia and Thiourea, Chemical Engineering Science 61(10), 3186-3197. da Silva G. et al., (2006), Reaction and Mass Transfer Effects During the Foaming of Concentrated Water-in-Oil Emulsions by the Nitrosation of Thiourea, AIChE J 52(4), 1558-1565.

Clark PK, Interpretation of 29 CFR 1910.109 Relative to Peroxides and Chlorates in Blasting Agents, Slurries, and Emulsions, OSHA, USA, 1991.

* cited by examiner

*Primary Examiner* — James McDonough
(74) *Attorney, Agent, or Firm* — Edwards Wildman Palmer LLP; Peter C. Lauro, Esq.

(57) ABSTRACT

A method for gassing an emulsion explosives to sensitize the explosive to detonation and/or for density modification is described. The method comprises reacting a compound having an enol group, or a deprotonated enolate form of the enol group, with a nitrosating agent to generate nitric oxide to gas the explosive. The compound reacted with the nitrosating agent can be a lactone such as ascorbic acid. Dinitrogen trioxide is particularly useful as the nitrosating agent.

20 Claims, 3 Drawing Sheets

GASSING OF EMULSION EXPLOSIVES WITH NITRIC OXIDE

FIELD OF THE INVENTION

The present invention relates to the gasification of emulsion explosives for sensitisation of the explosives to detonation and/or for density modification. The invention finds particular application in the mining industry.

BACKGROUND OF THE INVENTION

Emulsion and blended ANFO-emulsion explosives constitute the majority of explosives used in the mining industry. These types of explosives require sensitisation prior to detonation by the introduction of void spaces into the emulsion matrix. Void spaces create hotspots within the explosive sensitising it to detonation. The density of a typical emulsion explosive is around 1,300 kg $m^{-3}$ and this density needs to be reduced to around 1,000 kg $m^{-3}$ for an efficient blast. As such, gas is introduced into the emulsion equivalent to around one third of the total emulsion density. This gas may be introduced, for example, by sparging air through the emulsion or blending in hollow glass micro balloons or porous material.

A more effective means of sensitisation is through chemical gassing, where a chemical reaction is used to generate gas bubbles within the emulsion. Chemical gassing usually involves the reaction of nitrite with ammonia or other amine substrate such as thiourea to produce nitrogen gas. However, such processes are typically slow, especially at low to ambient temperatures, which can cause significant mine-site delays.

SUMMARY OF THE INVENTION

In a first aspect of the present invention there is provided a method for gassing an emulsion explosive to sensitise the explosive to detonation, comprising reacting a compound having an enol group, or a deprotonated enolate form of the enol group, with a nitrosating agent to generate nitric oxide to gas the explosive.

Typically, the nitric oxide will be generated in tie emulsion explosive to sensitise the explosive to detonation. Alternatively, the nitric oxide may be generated remotely from the emulsion explosive and be introduced into tie explosive.

Typically also, the reaction of the nitrosating agent with the compound will produce one or more O-nitroso products which decompose to yield the nitric oxide. The nitrosating agent may be any such agent which reacts with the enol group or enolate form thereof to generate the nitric oxide under the conditions utilised. Most preferably, the nitrosating agent will be generated in situ.

Similarly, any compound comprising an enol group or enolate form thereof which reacts with the nitrosating agent to generate the nitric oxide can be utilised. Preferably, the compound will be stabilised by resonance, a ring structure of the compound, a functional group remote from the enol group, or otherwise. More preferably, the compound will have a 5 or 6 membered ring structure and most preferably, the ring structure will incorporate the enol group.

Preferably, the enol group of the compound utilised in a method of the invention will be an enediol.

The compound may for instance comprise a lactam or lactone. The lactone can be selected from the group consisting of ascorbic acid and ascorbic acid isomers, and modified forms, derivatives and deprotonated forms of ascorbic acid and ascorbic acid isomers. Generally, ascorbic acid or ascorbate will be utilised in a method embodied by the invention.

Preferably, the nitrosating agent will be generated in the emulsion explosive, Most preferably, the nitrosating agent will be $N_2O_3$ (dinitrogen trioxide).

In another aspect of the present invention there is provided a method for gassing an emulsion explosive to sensitise the explosive to detonation, comprising reacting ascorbic acid or ascorbic acid isomer, or a modified form derivative, or deprotonated form of ascorbic acid or ascorbic acid isomer, with a nitrosating agent to generate nitric oxide to gas the explosive.

In yet another aspect, there is provided an emulsion explosive sensitised to detonation by method of the invention.

Accordingly, in a further aspect of the present invention there is provided an emulsion explosive gassed with nitric oxide generated by reaction of a compound comprising an enol group, or a deprotonated form of the enol group, with a nitrosating agent.

The gassing of the emulsion explosive modifies the density of the explosive. Hence, the invention in a further aspect extends to the reaction of a compound comprising an enol group, or a deprotonated form of the enol group, with a nitrosating agent to modify the density of an emulsion explosive. Similarly, the invention further encompasses the resulting density modified emulsion explosive.

Typically, the compound comprising the enol group or deprotonated form of the enol group will be reacted with the nitrosating agent in a method embodied by the invention under acidic conditions.

All publications mentioned in this specification are herein incorporated by reference. Any discussion of documents, acts, materials, devices, articles or the like which has been included in this specification is solely for the purpose of providing a context for the present invention. It is not to be taken as an admission that any or all of these matters form part of the prior art base or were common general knowledge in the field relevant to the present invention as it existed in Australia or elsewhere before the priority date of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The features and advantages of the present invention will become further apparent from the following detailed description of preferred embodiments and the accompanying figures.

BRIEF DESCRIPTION OF THE ACCOMPANYING FIGURES

DETAILED DESCRIPTION OF PREFERRED EMBODIMENTS

Figure 1:
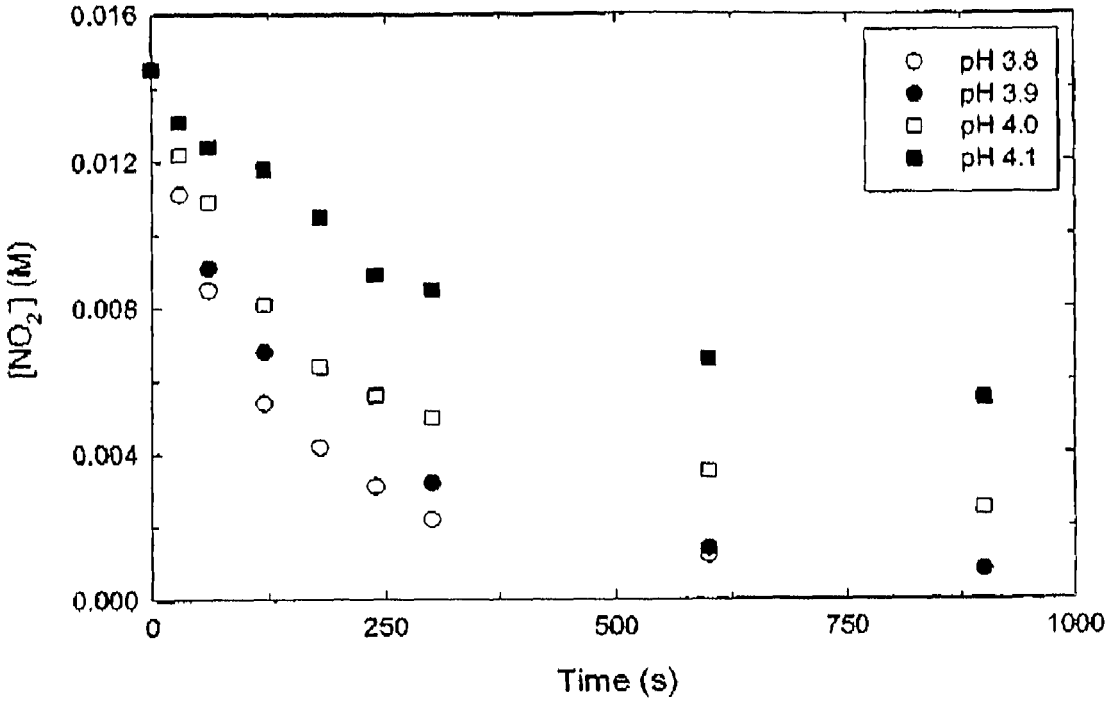
FIG. 1 is a graph showing rate of reaction of nitrite with ascorbic acid at 25° C. and varying pH values.

For the purposes of describing preferred embodiments, compound(s) which can be utilised as the substrate for the generation of the nitric oxide gas in accordance with the invention will be referred to as the "enol compound" or is "enol compounds".

Examples of enol compounds which may find use in embodiments of the invention include, but are not limited to, lactones and the enol isomers of lactams and in particular β-lactam, γ-lactam and d-lactam compounds and their derivatives, and the enol isomers of 1,3-dicarbonyls and 1,3,5-tricarbonyls, and derivatives thereof which include an enol or enolate groups. Examples of lactones include ascorbic acid and its deprotonated form ascorbate, γ-butyrolactone, ϵ-caprolactone, and D-glucono-delta-lactam.

Typically, the enol compound reacted with the nitrosating agent will be a lactone and most usually ascorbic acid or ascorbate. Erythorbic acid (also known as D-araboascorbic acid) is a stereoisomer of ascorbic acid that differs from ascorbic acid only in the relative position of the hydrogen and hydroxyl groups on the fifth carbon atom in the molecule. Erythorbic acid, therefore, has similar properties to ascorbic acid and may also find use in methods of the present invention.

Acetal and ketal derivatives of ascorbic acid in which the enediol group of the lactone ring of the compound remains intact and which way find application in methods of the invention are, for instance, disclosed in U.S. Pat. No. 4,153,613, and include the tetradecanal acetal of ascorbic acid, the hexadecanal acetal of ascorbic acid, the oleyl aldehyde of ascorbic acid, the 2-nonadecanone ketal of ascorbic acid and the 3-phenylpropan-1-al acetal of ascorbic acid. Further derivatives of ascorbic acid or erythorbic acid which may find use in the methods described herein include 5,6-anhydro-L-ascorbic acid, 5,6-anhydro-D-erythorbic acid, 6-bromo-6-deoxy-L-ascorbic acid, 6-deoxy-6-thiophenoxy-L-ascorbic acid, and 6-deoxy-6-phenoxy-L-ascorbic acid methods, the synthesis of which are described in U.S. Pat. No. 4,368,330.

Other derivatives of ascorbic acid that may be utilised include 6-aliphatic $C_{2-20}$-carboxylic acid esters of ascorbic acid which can be produced by esterifying the ascorbic acid with an aliphatic $C_{2-20}$-carboxylic acid halide in the presence of an N,N-dialkyl-alkanecarboxylic acid amide, or a suitable cyclic amide or cyclic carbamide, as described in U.S. Pat. No. 4,997,958.

The enol or enolate form of the compound employed for the gassing of the emulsion explosive will normally be utilised in the explosive at a concentration in a range of from about 0.005 M to about 0.04 M and more preferably, in a range of 0.01 M to 0.025 M.

The term "modified form" of ascorbic acid or ascorbic acid isomer encompasses forms in which one or more atoms or chemical groups of these compounds has been replaced or substituted with a different atom, chemical or functional group, and compounds in which one or more functional groups have been chemically modified compared to ascorbic acid or the ascorbic acid isomer.

The nitrosating agent can, for instance, be selected from the group consisting of $N_2O_3$ (dinitrogen trioxide), ONCl (nitrosyl chloride), ONBr (nitrosyl bromide), ONSCN (nitrosyl thiocyanate), ONI (nitrosyl iodide), nitrosothiourea, nitrosyl thiosulfate, $HNO_2$ (nitrous acid), $OH^+$, $ON^+OH_2$, or an inorganic nitrosyl complex such as nitroprusside. Typically, dinitrogen trioxide will be employed as the nitrosating agent and can be formed in situ from nitrite ion and $H^+$ from an acid used in the emulsion explosive. Any suitable nitrite ion salt such as sodium or potassium nitrite can be used as the source of the nitrite ions. Typically, the nitrosating agent will be utilised or generated in the emulsion explosive. The nitrite salt is typically utilized in the concentration range of about 0.01 M to about 0.04 M and more preferably at around 0.015 M.

The emulsion explosive can be any water-in-oil emulsion comprising a discontinuous phase of an aqueous oxidiser solution containing an oxidiser salt, that is dispersed in a continuous phase of an organic fuel in the presence of one or more emulsifying agents. Such emulsion explosives are well known in the art.

The oxidiser salt can be selected from ammonium, alkali metal and alkaline earth nitrates, chlorates, perchlorates and mixtures of the foregoing. Typically, the oxidiser salt will comprise at least about 50% by weight of the total emulsion explosive composition, more preferably at least about 60%, 70% or 80% by weight and most preferably, at least about 90% by weight of the total emulsion explosive. In a particularly preferred embodiment, the oxidiser salt will be ammonium nitrate alone or in combination with sodium nitrate, potassium nitrate and/or calcium nitrate. So-called ammonium nitrate-fuel oil (ANFO) mixtures form the bulk of industrial explosives consumption. The ammonium salt can be present in the form of porous solid prilled ammonium salt, be dissolved in the aqueous phase of the emulsion, or both. A particularly preferred ANFO emulsion explosive which may be gassed in accordance with the present invention comprises about 90% to 96% ammonium nitrate by weight of the emulsion composition dissolved in the aqueous phase of the emulsion, and more preferably about 94% by weight ammonium nitrate.

Emulsifiers commonly used in emulsion explosive compositions include sorbitan monooleate (SMO), polyisobutane succinic anhydrides (PIBSA) and amine derivatives of PIBSA, and conjugated dienes and aryl-substituted olefins as described, for instance, in U.S. patent application Ser. No. 0030024619.

The fuel can be any fuel commonly utilised in emulsion explosives such as diesel fuel. Fuels that can be utilised are also described in U.S. patent application Ser. No. 0030024619 and include paraffinic, olefinic, napthenic, and paraffin-napthenic oils, animal oils, vegetable oils, synthetic lubricating oils, hydrocarbon oils in general and oils derived from coal and shale.

The oxidiser salt can be added as a powder or in solution form to the emulsion explosive. One or more of the enol compound, any nucleophilic species for generating the nitrosating agent and the acid may be mixed with the oxidiser salt or be present in the emulsion explosive. In a particularly preferred embodiment of the present invention, a gassing solution comprising sodium nitrite in water together with the selected enol compound and a suitable acid such as acetic acid, citric acid or other carboxylic acid, is introduced into the emulsion explosive at the bore hole by entraining the gassing solution into a stream of the emulsion explosive employing any conventionally known apparatus commonly used in the field of emulsion explosives such as pumping or pressure based apparatus.

Such apparatus are typically adapted to subject the emulsion explosive to mixing or mixing and shear to homogenise the explosive. The gassing solution can be introduced into the emulsion explosive before or after the emulsion explosive has been mixed, although it is desirable to combine the gassing solution with the explosive prior to the mixing of the explosive to ensure even dispersion of the gassing solution throughout the explosive. Apparatus which may be suitable for priming a bore hole with a gassing solution and emulsion explosive mixture is for instance described in U.S. Pat. No. 6,877,432. Alternatively, the gassing solution can be introduced directly into the emulsion explosive by pumping the gassing solution through a lance or other appropriate device prior to mechanically mixing the explosive.

The pH at which the reaction between the enol compound and the nitrosating agent proceeds will generally be chosen such that the reaction and thereby the gassing of the emulsion explosive proceeds at a predetermined rate. Preferably, the lactone will be reacted with the nitrosating agent at a pH of about 4.1 or less and will preferably, at a pH in a range of about 3.0 to 4.1 and most preferably, at a pH in a range of from about 3.8 to 4.1.

Ascorbic acid has previously been reported to react with nitrite ion by a multi-step reaction mechanism involving the generation of the nitrosating agent dinitrogen trioxide ($N_2O_3$). However, nitrite ion can be replaced by another nucleophilic species such that a nitrosating agent other than dinitrogen trioxide is formed. Without being limited by theory, it is believed the nitrosating agent nitrosates the enol group of the ascorbic acid (or its deprotonated anion) producing an unstable O-nitroso product which undergoes a series of rapid decomposition steps to ultimately yield nitric oxide and other reaction products.

Ascorbate ion may be used as an alternative to ascorbic acid to generate the nitric oxide in one or more forms of the invention.

The invention will now be further described below by way of a non-limiting Example.

EXAMPLE 1

The reaction of ascorbic acid with dinitrogen trioxide to generate nitric oxide for gassing of an emulsion explosive is evaluated. Two main experimental techniques were employed. The first technique studies the intrinsic kinetics of the reaction in aqueous solution by following decreasing nitrite ion concentration over time. The second monitors the density reduction of a small sample of emulsion explosive as it undergoes gassing.

1.1 Aqueous Experiments

Aqueous experiments were conducted in a 250 mL reaction vessel immersed in a temperature-regulated water bath. The reactor contents were kept homogenised during the experiments by continuous stirring. Each experiment utilised 100 mL of reaction solution designed to mimic the aqueous phase of a typical ammonium nitrate based emulsion explosive but excluding the ammonium nitrate. The solution pH was regulated with acetic acid with the addition of sodium carbonate as buffer at 0.04 g per 100 mL of solution. Ascorbic acid was added to the solution (typically 0.02 M) prior to the addition of the acid. The reaction was initiated by the injection of a small quantity of concentrated sodium nitrite solution providing an initial nitrite ion concentration of 0.0145 M.

Reaction progress was followed by observing the change in nitrite ion concentration with time. To achieve this, 0.1 mL samples were pipetted from the reactor at periodic intervals and the reaction in each sample stopped by quenching with 2.5 mL of sodium hydroxide solution. Each sample was then analysed for the concentration of nitrite ion using a Dionex DX-100 ion chromatograph.

1.1.1 pH Effect

A series of experiments were conducted to examine the effect of solution pH on the rate of gassing. The solution pH is an important parameter in the gassing of emulsion explosives due to the high cost associated with acid addition. Here, the pH has been varied between 3.8 and 4.1 and the results are shown in FIG. 1. As can be seen, the figure demonstrates that the rate of reaction increases significantly with decreasing pH. The result obtained at pH 4.1 is nearly comparable in rate to traditional chemical gassing techniques and indicates the pH value should preferably be maintained at 4.1 or below.

1.1.2 Temperature Effect

Figure 2:
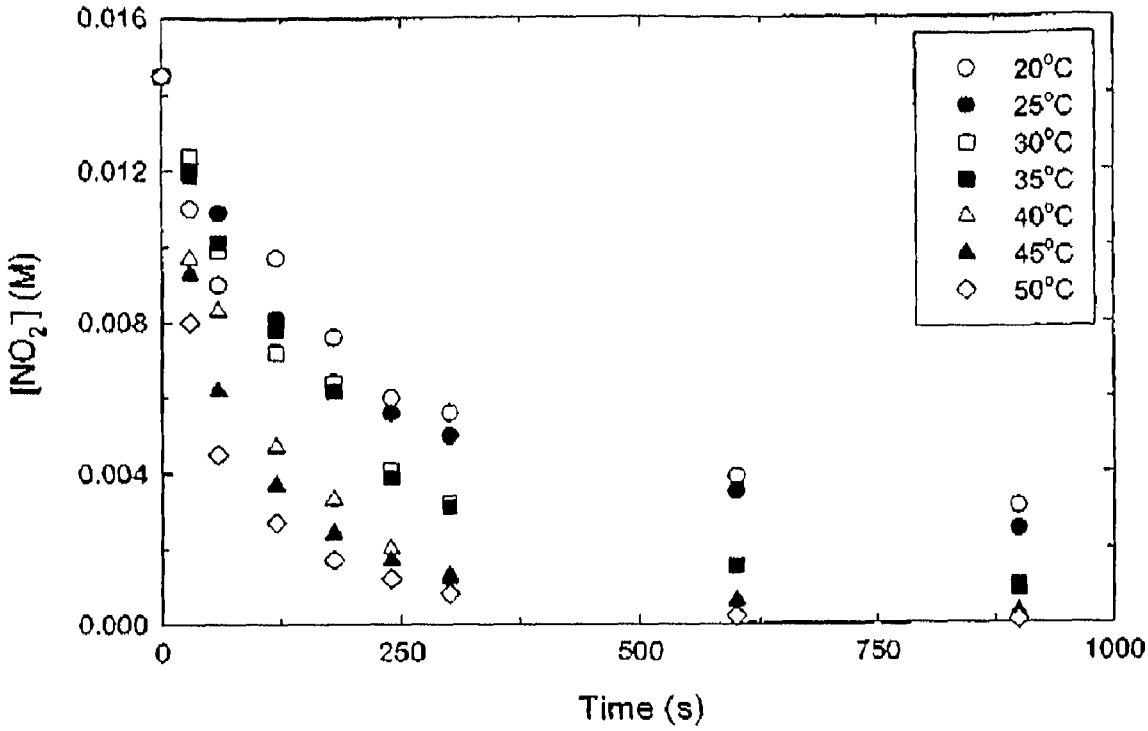
FIG. 2 is a graph showing the rate of reaction of nitrite ions with ascorbic acid at pH 4.0, and varying temperatures.

Another series of aqueous experiments were performed in which the reaction temperature was varied between 20° C. and 50° C. The results are shown in FIG. 2 where it can be seen that the rate of reaction increases with increasing temperature.

2.1 Emulsion Experiments

2.1.1 Emulsion Gassing Kinetics

A gassing experiment was conducted utilising ascorbic acid with an actual emulsion explosive as described in Example 1.1 above to study differences in rate resulting from operating in a non-homogeneous multiphase system, and to observe the amount of nitric oxide dissolved in solution. This experiment was performed at 25° C. and pH 3.9. The emulsion explosive comprised 92 weight % aqueous phase and 8 weight % oil phase. The aqueous phase comprised 80 weight % ammonium nitrate and 20 weight % water, while the oil phase comprised 73 weight % diesel fuel and 27 weight % emulsifier. The results are shown in FIG. 3.

Figure 3:
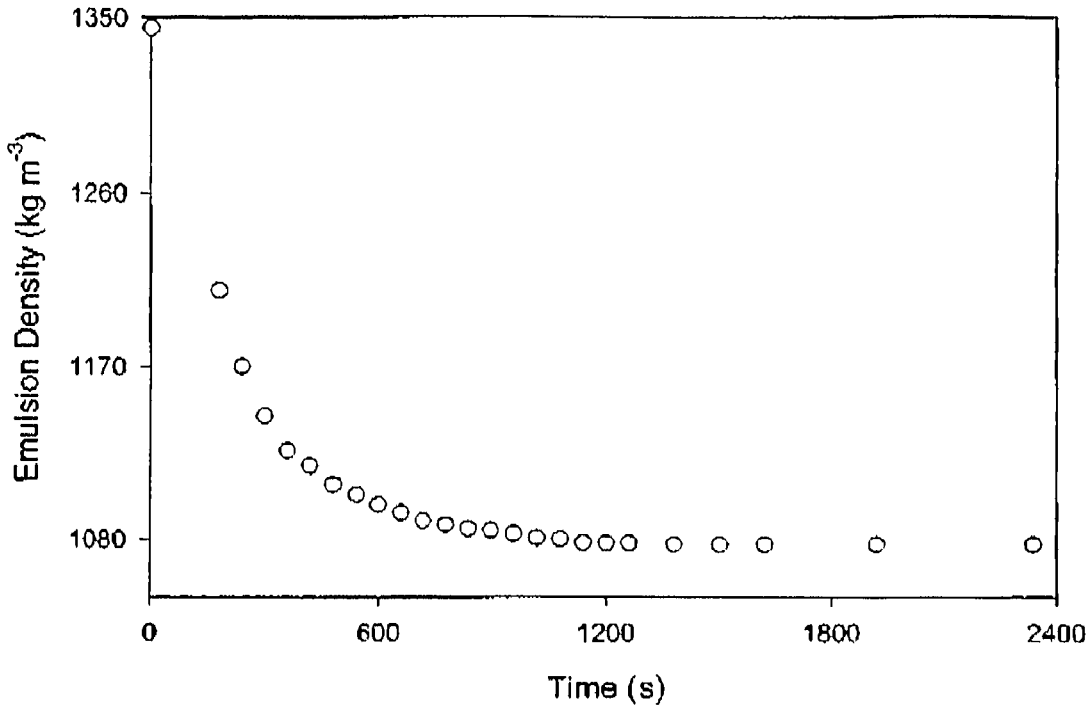
FIG. 3 is a graph showing the gassing rate of an emulsion explosive with ascorbic acid at 25° C. and pH 3.9.

As shown in FIG. 3, the gassing of the emulsion occurred rapidly with density reduction ceasing at around 1000 s. There is also little evidence of a lag or induction period as is often observed with other chemical gassing processes.

The use of rapid nitric oxide gassing offers advantages over traditional chemical gassing processes other than improved gassing kinetics. For example, ascorbic acid is cheap and readily available. It is also non-toxic and as such provides an excellent replacement for toxic gassing reagents. Moreover, the rapid gassing kinetics make it feasible to operate at higher solution pH values. It is also less important to maintain the emulsion at its production temperature reducing the need for expensive insulation.

It will be appreciated by persons skilled in the art that numerous variations and/or modifications may be made to the invention without departing from the spirit or scope of the invention as broadly described. The present embodiments are, therefore, to be considered in all respects illustrative and not restrictive.

The invention claimed is:

1. A method for modifying the density of an emulsion explosive, comprising reacting a compound having an enol group, or a deprotonated enolate form of the enol group, with a nitrosating agent to generate nitric oxide to gas the explosive.

2. A method according to claim 1 wherein the compound is reacted with the nitrosating agent under acidic conditions.

3. A method according to claim 1 or 2 wherein the nitric oxide is generated in the emulsion explosive by the reaction.

4. A method according to claim 1 wherein the reaction of the nitrosating agent with the compound produces one or more O-nitroso products which decompose to yield the nitric oxide.

5. A method according to claim 1 wherein the compound is selected from the group consisting of lactones, enol isomers of lactams, and derivatives of enol isomers of lactones and lactams.

6. A method according to claim 5 wherein the compound comprises a lactone.

7. A method according to claim 5 or 6 wherein the compound has a 5 or 6 membered ring structure incorporating the enol group.

8. A method according to claim 1 wherein the enol group is an enediol group or a deprotonated form of an endiol group.

9. A method according to claim 1 wherein the compound is selected from the group consisting of ascorbic acid and ascorbic acid isomers, and modified forms, derivatives and deprotonated forms of ascorbic acid and ascorbic acid isomers.

10. A method according to claim 9 wherein the compound is selected from ascorbic acid and ascorbate.

11. A method according to claim 1 or 2 wherein the nitrosating agent is generated in the emulsion explosive.

12. A method according to claim 1 wherein the nitrosating agent is selected from the group consisting of $N_2O_3$, ONCl, ONBr, ONSCN, ONI, nitrosothiourea, nitrosyl thiosulfate, $HNO_2$, $ON^+$, $ON^+OH_2$, and inorganic nitrosyl complexes.

13. A method according to claim 12 wherein the nitrosating agent is $N_2O_3$.

14. A method according to claim 13 wherein the $N_2O_3$ is formed in the emulsion explosive from nitrite ion and $H^+$.

15. A method according to claim 14 wherein a nitrite ion salt is used as a source of the nitrite ions.

16. A method according to claim 2 wherein the compound is reacted with the nitrosating agent at a pH of 4.1 or less.

17. An emulsion explosive sensitized to detonation by method as defined in claim 1.

18. An explosive according to claim 17 being a water-in-organic fuel emulsion.

19. An explosive according to claim 17 being a nitrate-fuel oil (ANFO) emulsion explosive.

20. A method according to claim 1 being a method for gassing the emulsion explosive to sensitize the explosive to detonation.

* * * * *